United States Patent [19]

Tanson

[11] 4,400,207

[45] Aug. 23, 1983

[54] METHOD OF PRODUCING METAL ALLOYS

[75] Inventor: Aloyse Tanson, Luxembourg, Luxembourg

[73] Assignee: Continental Alloys S.A., Dommeldange, Luxembourg

[21] Appl. No.: 377,035

[22] Filed: May 11, 1982

[30] Foreign Application Priority Data

May 13, 1981 [LU] Luxembourg ..... 83362

[51] Int. Cl.[3] ..... C22B 1/08

[52] U.S. Cl. ..... 75/129; 75/3

[58] Field of Search ..... 75/129, 3, 4, 5

[56] References Cited

U.S. PATENT DOCUMENTS 3,837,843 9/1974 Pons ..... 75/3

4,128,417 12/1978 Lung ..... 75/3

*Primary Examiner*—P. D. Rosenberg

*Attorney, Agent, or Firm*—Herbert Dubno; Karl F. Ross

[57] ABSTRACT

The pulverulent metal oxide, especially molybdenum oxide is mixed, to increase the metal conversion, with a stoichiometric quantity of finely divided ferrosilicon. This mixture is combined with about 5% by weight bentonite as a binder and agitated with about 3 weight % water and formed into briquettes with the aid of a conventional briquetting unit. To facilitate an exact metering of the additive of the metal oxide to the steel melt, the smallest caliber possible briquettes are produced.

6 Claims, No Drawings

METHOD OF PRODUCING METAL ALLOYS

FIELD OF THE INVENTION

The present invention relates to a method of preparing pulverulent metal oxides with a view to their use as alloying additives for steel melts. More particularly the invention relates to a method of producing metal alloys, especially, molybendum-steel alloys.

BACKGROUND OF THE INVENTION

A known alloying technique utilizes the addition of molybdenum oxide to steel melts via the transformation of the oxide to ferromolybdenum. In this case, molybdenum oxide ($MoO_3$) with conversions up to 90% Mo can be used directly as an alloying medium.

It is also known that in the treatment of the corresponding ores dust-like oxides are produced with unpleasant properties: thus the uptake of molybdenum oxides for humans and animals even in concentrations in parts per million should be avoided. For this reason and also on the ground of economy, the losses of molybdenum oxide by spewing of dust in the introduction thereof into steel melts, should be avoided.

Thus it is customary to agglomerate molybdenum oxide with the aid of binders and to introduce it into the melt as shaped bodies. In a conventional agglomeration technique, the oxide powder is pressed into briquettes with about 12 percent by weight of pitch (binder) which have the form and dimensions of building bricks. The briquettes are introduced into melts in a manner such that the yield of molybdenum is about 90% Mo.

It has been found, regrettably, that this approach to the method is not without disadvantages. Thus, while the amount of dust spewed by comparison to that spewed with the pure use of dust is reduced, it is not sufficiently diminished.

Furthermore, it has been noted that the pitch utilized as the binder can be carcinogenic even upon brief contact with the skin. Finally, conversions better than 90% in the case of expensive products such as molybdenum oxide are desirable.

OBJECTS OF THE INVENTION

An object of the invention is, therefore, to provide a method of treating dust-like metal oxides, especially molybdenum oxide, such that the described disadvantages of the state of the art are avoided.

Another object of this invention is to provide an improved method of treating a steel melt to increase the concentration of an alloying metal therein, especially in the production of molybdenum alloys.

Yet another object of this invention is to provide an improved method of producing a molybdenum alloy steel whereby the disadvantages of earlier methods are avoided.

DESCRIPTION OF THE INVENTION

These objects are attained, in accordance with the invention which provides for the mixing of the dust-like oxide, to increase its conversion upon the introduction thereof into the steel melt, with a stoichiometric quantity of a finely divided ferrosilicon, the mixture being complemented with about 5% by weight bentonite as a binder, agitated with about 3 weight % water, and formed into briquettes.

The ferrosilicon serves to ensure reduction of the oxide within the melt and thus increases the conversion of the molybdenum. The silicon oxide which is formed by the reduction migrates into the slag and thus does not interfere with the metallurgical operations.

To preclude an undesired increase in the silicon concentration of the steel, excesses of ferrosilicon are avoided.

The use of bentonite as the binder has been found to have several advantages:

Firstly, bentonite is an aluminum oxide based substance so that the binder, upon interaction of the briquette with the melt, enters the slag.

Secondly, bentonite is a binder which automatically eliminates the danger of carbonization of the steel melt which can occur when pitch-bonded bodies are utilized.

Thirdly, betonite is a completely harmless substance which is convenient to handle and need be utilized only in relatively small quantities.

For the most effective metering of the molybdenum into the melt, according to the invention, small caliber briquettes are utilized and hence conventional briquette-production units can be used.

The handling of small caliber briquettes which are of the traditional cushion shape is completely without problems. It is possible to store the shaped bodies in and utilize them from silos. The briquettes produced with only 5% by weight bentonite are abrasion resistant and can be introduced in a problem free manner into steel melts without crumbling as is the case with pitch-bound, large-caliber briquettes, and thus without dust loss.

According to another aspect of the invention, an alloying metal is introduced into a steel melt and a steel alloy is produced by initially combining ferrosilicon and an oxide of the alloying metal in stoichiometric proportions, forming briquettes with a bentonite binder of this composition and introducing the briquettes into a steel melt covered by a slag such that the metal oxide reacts with the ferrosilicon to produce silicon dioxide quantitatively and both iron and the alloying metal which enter the melt, the silicon dioxide being taken up by the slag.

The stoichiometric proportions correspond to the amount of ferrosilicon necessary to react with all of the oxygen of the metal oxide. For example, if the ferrosilicon contains equiatomic proportions of iron and silicon, the reaction can be described by the following formula:

$$3FeSi + 2MoO_3 \rightarrow 3SiO_2 + 2Mo + 3Fe$$

In this case, a stoichiometric proportion corresponds to 2 moles of the molybdenum oxide for each 3 moles of ferrosilicon.

SPECIFIC EXAMPLE

A 25 ton steel melt was bottom blown in a conventional converter to which briquettes fabricated on a conventional briquetting apparatus are added. The briquettes are prepared by intimately mixing 16.5 kg. of molybdenum trioxide dust, 14.25 kg. of FeSi in finely ground form, 1.54 kg. of bentonite and about 9.2 kg. of water. The briquetting machine used was of the type utilized for the hot briquetting of ore (see page 226 of *The Making, Shaping and Treating of Steel,* United States Steel Company, Pittsburgh, Pa. 1971) a steel melt was thereby alloyed with about 1% molybdenum.

I claim:

1. A process for preparing a pulverulent metal oxide as an alloying additive to a steel melt, which process consists essentially of the steps of mixing the oxide with a stoichiometric quantity of finely divided ferrosilicon, combining the mixture with about 5% by weight bentonite as a binder and with about 3% by weight water, agitating the mixture, and shaping the agitated mixture to briquettes.

2. The method defined in claim 1 characterized in that to facilitate precise metering, small caliber briquettes are produced.

3. The product manufactured according to the process of claim 1 or claim 2.

4. A method of producing an alloyed steel which comprises the steps of:

(a) forming a steel melt covered by a slag;

(b) preparing briquettes of an alloying metal by intimately mixing stoichiometric proportions of finely divided ferrosilicon and a dust-form oxide of an alloying metal, combining the resulting mixture with about 5% by weight bentonite and about 3% by weight water, and briquetting the resulting mixture; and (c) introducing the briquettes produced in step (b) into the melt formed in step (a) to cause the ferrosilicon of said briquettes to react with said metal oxide and form silicon oxide, thereby releasing said metal into said melt, said silicon dioxide passing into said slag.

5. The method defined in claim 1 or claim 4 wherein said metal oxide is molybdenum oxide.

6. A method of producing a molybdenum-alloy steel which comprises the steps of:

(a) forming a steel melt covered by a slag;

(b) preparing briquettes of $MoO_3$ by intimately mixing stoichiometric proportion of 3 moles of finely divided ferrosilicon and 2 moles of dust-form $MoO_3$, combining the resulting mixture with about 5% by weight bentonite and about 3% by weight water, and briquetting the resulting mixture; and (c) introducing the briquettes produced in step (b) into the melt formed in step (a) to cause the ferrosilicon of said briquettes to react with said $MoO_3$ and form silicon oxide, thereby releasing molybdenum metal into said melt, said silicon dioxide passing into said slag.

* * * * *